US007207238B2

(12) United States Patent
Feng

(10) Patent No.: US 7,207,238 B2
(45) Date of Patent: Apr. 24, 2007

(54) AUXILIARY BRAKE CONTROL SYSTEM

(76) Inventor: Zhide Feng, 1919 Atlas Ct., Troy, MI (US) 48083

( * ) Notice: Subject to any disclaimer, the term of this patent is extended or adjusted under 35 U.S.C. 154(b) by 0 days.

(21) Appl. No.: 10/512,111

(22) PCT Filed: Apr. 3, 2003

(86) PCT No.: PCT/US03/10327

§ 371 (c)(1),
(2), (4) Date: Oct. 21, 2004

(87) PCT Pub. No.: WO03/095259

PCT Pub. Date: Nov. 20, 2003

(65) Prior Publication Data

US 2005/0162002 A1 Jul. 28, 2005

Related U.S. Application Data

(60) Provisional application No. 60/427,235, filed on Nov. 19, 2002, provisional application No. 60/378,364, filed on May 8, 2002.

(51) Int. Cl.
*G05G 1/16* (2006.01)

(52) U.S. Cl. ..... 74/562.5; 74/480 R; 188/2 D

(58) Field of Classification Search ..... 74/480 R, 74/562.5; 188/2 D
See application file for complete search history.

(56) References Cited

U.S. PATENT DOCUMENTS

| | | | |
|---|---|---|---|
| 2,647,414 | A | 8/1953 | Nafe, Sr. et al. |
| 2,677,976 | A | 5/1954 | Berman |
| 2,710,547 | A | 6/1955 | Daverport |
| 2,720,121 | A | 10/1955 | Holum |
| 2,814,212 | A | 11/1957 | Garver |
| 3,174,359 | A | 3/1965 | Rose |
| 3,435,703 | A | 4/1969 | Allgaier |

*Primary Examiner*—Chris Schwartz
(74) *Attorney, Agent, or Firm*—Patwrite LLC; Mark David Torche

(57) ABSTRACT

An easy-installed auxiliary brake control system for driving practice of an automobile by means of an auxiliary brake actuator and two-component cables. The cables have an outer sheath portion and an inner cable portion. It connects an auxiliary brake actuator to a brake arm of the automobile. The auxiliary brake actuator rests on a floor of a passenger compartment of the automobile, without necessity of being secured to it. When an instructor acts on the auxiliary brake actuator, the brake arm is actuated through relative movement between the inner cable portion and the outer sheath portion of the cables. This system is significantly cheaper than prior arts, especially for installation, and damages on the automobile for installation are minimized.

21 Claims, 6 Drawing Sheets

AUXILIARY BRAKE CONTROL SYSTEM

CROSS-REFERENCE TO RELATED APPLICATION

This application is related to and claims convention priority on U.S. Provisional Patent Applications Nos. 60/378,364 filed on May 8, 2002 (Co-Driver Braking System) and 60/427,235 filed on Nov. 19, 2002 (Dual Brake Controller).

FIELD OF THE INVENTION

The present invention relates in general to the provision of auxiliary braking control for a vehicle and in particular to the provision of an auxiliary braking control system for a vehicle which permits brake operation by a person other than the vehicle operator.

BACKGROUND OF THE INVENTION

It is not uncommon for automobiles which are used in driver instruction courses to be equipped with an auxiliary braking mechanism whereby an instructor, occupying the passenger seat of the vehicle, can actuate the vehicle brakes in order to avoid a collision or other problems when the vehicle operator, typically a student driver, does not react in time to operate the brakes himself. Such systems are typically installed in the vehicle on a permanent basis and can take many different forms. One such form involves a so-called Bowden cable which includes a flexible yet strong wire or cable slidingly received within an outer flexible sheath. The sheath is anchored at one thereof to the vehicle adjacent the standard brake pedal and at the other end it is anchored to the vehicle or to part of the auxiliary brake system in the passenger compartment. The inner cable is typically connected at one end to the standard brake pedal while the other end of the cable is connected to an auxiliary brake pedal in the passenger compartment. When the auxiliary brake pedal is operated by the instructor, as by pushing thereagainst, the inner cable is caused to slidingly move within the sheath with the end result that the inner cable pulls on the standard brake pedal to effect a brake application. This system requires a complex routing mechanism for the inner cable and the outer sheath so that a proper and effective pulling force is applied to the standard brake pedal during operation and so that normal brake operation by the student is not impeded by the auxiliary control system. Examples of prior art auxiliary brake control systems for vehicles are found in U.S. Pat. No. 2,647,414 (Nafe et al); U.S. Pat. No. 2,677,976 (Berman); U.S. Pat. No. 2,710,547 (Davenport et al); U.S. Pat. No. 2,720,121 (Holum); U.S. Pat. No. 2,814,212 (Garver); U.S. Pat. No. 3,174,359 (Rose); and U.S. Pat. No. 3,435,703 (Allgaier); as well as in Swedish Patent 9500107-9 (Hakansson et al) published Jul. 14, 1996 and in Swedish Patent No. 503,019 of Mar. 11, 1996.

One problem associated with prior art auxiliary brake control systems is that such systems are generally intended more for permanent or semi-permanent installation in the vehicle in question. This type of installation can degrade the resale value of the vehicle if the auxiliary control system must be removed prior to resale. Additionally, such systems are not practical for the average vehicle owner who might wish to provide individual driving instruction to a friend or relative in a private vehicle. In such a situation there would be no need or desire to have a permanent installation of an auxiliary brake control system. It would be much more desirable is such a system were available which could be readily installed for use and readily removed after use without requiring the aid of a professional installer and which would not result in permanent "damage" to the vehicle when the system is no longer required. Such a system should be available commercially as a kit of parts at hardware stores or automotive supply retailers for purchase by the potential user.

SUMMARY OF THE INVENTION

The present invention overcomes the problems associated with prior art auxiliary brake control systems by providing a system which uses a minimum number of parts, which can be readily installed by an average handyman, which makes use of existing components or features of the vehicle with which it is to be used, and which does not require the provision of a permanent or fixed component in, at least, the passenger compartment of the vehicle.

The present invention makes use of a two-component cable system, such as a so-called Bowden cable, which involves a flexible yet strong outer sheath portion and a flexible yet strong inner cable portion which is slidingly located within the outer sheath portion, such that the inner cable portion projects beyond the two ends of the sheath portion. One end of the sheath portion is fixedly connected to a base member which can be positioned anywhere within the passenger compartment of the vehicle such that it is conveniently accessible to one foot of the instructor. The base member need not be affixed to the vehicle in any manner at all. The opposite end of the outer sheath portion is removably connected to a first bracket member that can be secured to the standard brake pedal on the operator's side of the vehicle.

The end of the inner cable portion that projects beyond the one end of the outer sheath is connected to one end of an auxiliary brake pedal that is pivotally connected to the base member such that if the auxiliary brake pedal is actuated, as by pressing thereon, the effect is to pull the inner cable out of the outer sheath portion which is fixed to the base member. The opposite end of the inner cable, that projects beyond the opposite end of the sheath member, is fixedly connected to a second bracket member that can be secured to the vehicle floor below the standard brake pedal, utilizing components that should already exist in the floor. It may be necessary to provide customized or semi-customized second bracket members to accommodate different makes and models of vehicles.

At least a section between the respective ends of the outer sheath portion of the two-component cable utilized in the present invention is unconstrained between the respective ends of the outer sheath portion. It is not held or otherwise supported in a secure manner to the vehicle. It is free to move at will and will normally just lie on the vehicle floor and/or a console as it extends from the base member in the passenger compartment to the brake pedal in the operator's compartment. While it would be usual for the base member to be located in the standard passenger compartment at the front of the vehicle, adjacent the vehicle operator, there is nothing other than the length of the cable to restrict the location of the base member, and hence of the instructor. Thus, given a sufficient length of cable the instructor and the base member could be located in a rear passenger compartment rather than in a front passenger compartment, as desired.

Once the auxiliary brake control system of this invention has been installed in the vehicle the instructor will be able to apply the vehicle brakes as desired or required in an emergency situation. The instructor need only step on the auxiliary brake pedal to effect a resulting application of the vehicle's brakes through operation of the standard brake pedal. When the auxiliary brake pedal is depressed the effect is to try to lengthen or reposition the inner cable portion of the two-component cable relative to the outer sheath portion. Since neither the inner cable portion nor the outer sheath portion can stretch or compress, and since the one end of the outer sheath portion is fixed in space relative to the base member, which in turn is fixed in space relative to the vehicle, the operation of the auxiliary brake pedal by the instructor will mean that there is a tendency to shorten the distance between the fixed ends of the outer sheath portion. Since that distance cannot be physically shortened due to the non-stretchable and non-compressible nature of the components the two-component cable will flex with the result that the opposite end of the outer sheath portion will push against the standard brake pedal and depress it sufficiently to operate the vehicle's brakes and to thus slow the vehicle down or even bring it to a halt. Furthermore, given the flexible nature of the two-component cable the normal braking effect will not be hampered by the installation of the auxiliary brake control system of this invention.

In summary of the foregoing the present invention may be considered to provide an auxiliary brake control system for a wheeled vehicle having wheel brakes, and a brake pedal in an operator's compartment of the vehicle, controllable by a vehicle operator, the brake pedal being secured to a brake arm pivotally attached to a frame member in an operator's compartment of the vehicle and being positioned above a floor section of such vehicle. The auxiliary brake control system comprises: an auxiliary brake actuator arbitrarily positionable in a passenger compartment of such vehicle, the actuator including a base member and an auxiliary pedal member pivotally attached to the base member; an elongated flexible cable member including an outer sheath portion and an inner cable portion within the sheath portion; first means connecting a distal end of the outer sheath portion to one of the base member and the auxiliary pedal member; second means connecting the opposite, proximal, end of the outer sheath portion to one of the brake arm and the floor section of said vehicle; third means connecting a distal end of the inner cable portion, extending beyond the distal end of the outer sheath portion, to the other of the base member and the auxiliary pedal member; and fourth means connecting the opposite, proximal, end of the inner cable portion, extending beyond the proximal end of the outer sheath portion, to the other of the brake arm and the floor section of said vehicle. At least a section between the distal and proximal ends of the outer sheath portion of the cable member is unconstrained. When a passenger applies force on the auxiliary pedal member, the outer sheath portion of the cable member will move relative to the inner cable portion to effectively reduce the distance that the proximal end of the inner cable portion extends beyond the proximal end of the outer sheath portion, thereby causing the brake arm to move sufficiently to apply the vehicle wheel brakes.

The present invention may also be considered to provide an auxiliary brake control system for a vehicle having wheel brakes, and a brake pedal in an operator's compartment of the vehicle, controllable by a vehicle operator, the brake pedal being secured to a brake arm pivotally attached to a frame member in the operator's compartment of the vehicle and being positioned above a floor section of such vehicle. The auxiliary brake control system comprises: an auxiliary brake actuator positionable in a passenger compartment of such vehicle, the actuator including a base member and an auxiliary pedal member pivotally attached to the base member; a cable member including an outer sheath portion and an inner cable portion within the outer sheath portion; first means connecting a distal end of the outer sheath portion to the base member: second means locating the opposite, proximal, end of the sheath member at the brake arm; third means connecting a distal end of the inner cable portion to the auxiliary pedal member; and fourth means connecting the opposite, proximal, end of the inner cable portion to the floor section of the vehicle. At least a section between the first and second means of the cable member is unconstrained. When an individual applies force on the auxiliary pedal member the outer sheath portion of the cable member will move relative to the inner cable portion such that the second connecting means will act on the brake arm to apply the vehicle wheel brakes.

The above and other features of this invention will now be described with reference to the drawings.

REFERENCE NUMERALS IN DRAWINGS

| | | | |
|---|---|---|---|
| 10 | apparatus | 12 | floor section |
| 14 | firewall section | 16 | brake arm |
| 18 | suitable mount | 20 | brake pedal pad |
| 22 | auxiliary brake actuator | 24 | cable member |
| 26 | outer sheath portion | 28 | inner cable portion |
| 30 | base member | 32 | base |
| 34 | support structure | 36 | auxiliary brake pedal |
| 38 | bottom wall | 40 | side wall |
| 42 | front wall | 44 | upper or lower aperture |
| 45 | slot | 46 | central aperture |
| 48 | bolt or machine screw | 50 | flange |
| 51 | clamp | 52 | pedal arm |
| 54 | pedal pad | 56 | upper section |
| 58 | intermediate section | 60 | lower section |
| 62 | transverse hole | 64 | hole |
| 66 | pin | 66a | hexagonal head |
| 66b | shank portion | 68 | connector member |
| 70 | side wall | 72, 72' | lug |
| 74, 74' | opening | 76 | connecting pin |
| 78 | flange portion | 80 | cylindrical portion |
| 82 | extending lug | 84 | slot |
| 86 | tension spring | 86a, 86b | spring arm |
| 88 | mounting bracket | 90 | inverted U-shaped section |
| 92 | side wall | 94 | side wall |
| 96 | bight portion | 98 | threaded hole |
| 100 | thumbscrew | 102 | flange portion |
| 104 | hollow cylinder | 105 | bracket |
| 106 | stud | 108 | post |
| 110 | post | 112 | hexagonal head |
| 114 | groove | 116 | bar |
| 118 | slot | 120 | U-shaped slot |
| 120a | arm | 121 | thumbscrew |
| 122 | side flange | 126 | compression spring |
| 124 | proximal end of inner cable portion | | |
| 128 | tube | 130 | nut |
| 132 | washer | 134 | stud |
| 136 | section of outer sheath portion | | |
| 138 | section of outer sheath portion | | |
| 140, 140' | threaded end | 142 | adjustment member |
| 144 | central flange | 146, 146' | threaded tube |

DETAILED DESCRIPTION—FIG. 1 THROUGH FIG. 15—PREFERRED EMBODIMENT

Figure 1:
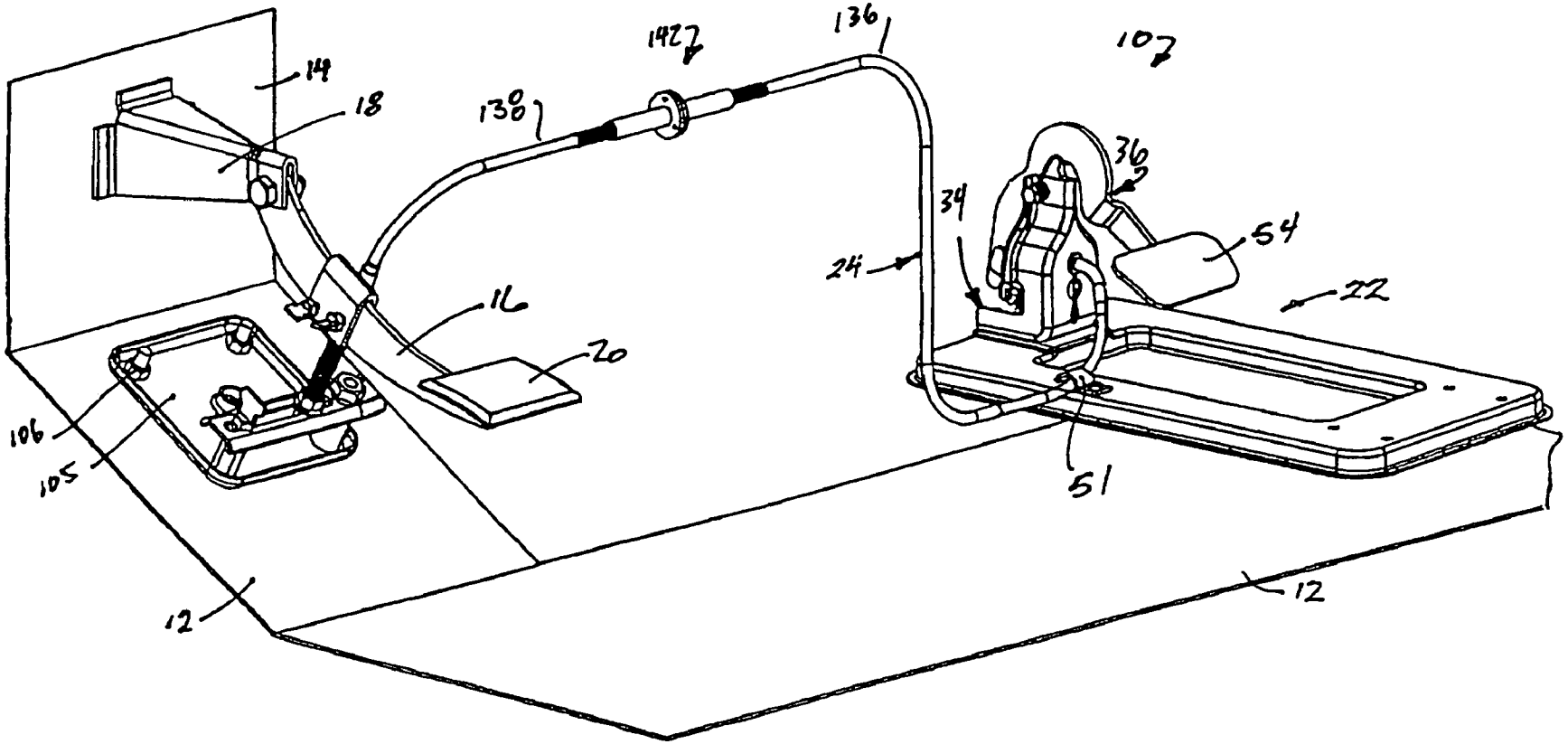
FIG. 1 is a schematic view showing the general layout of the present invention as it would be used in a vehicle.

FIG. 1 illustrates in a generally schematic nature the layout of the apparatus 10 of the present invention. There, it will be seen that a wheeled vehicle (not shown) has a floor section 12 and a firewall section 14 below the vehicle dashboard (not shown). In a typical situation the vehicle will have a brake arm 16 pivotally attached at one end to a suitable mount 18 on the firewall and carrying a brake pedal pad 20 at the opposite end thereof. In normal operation, when the vehicle operator senses a need to slow or stop the vehicle the operator will step on the pad 20 to depress the brake arm 16 to apply brake pressure to the brakes of the vehicle. Most vehicle brakes are power assisted so that the operator does not have to exert an inordinate amount of pressure on the pad 20 to bring the vehicle to a halt.

With the auxiliary brake control system of the present invention an auxiliary brake actuator 22 is positionable in the passenger compartment of the vehicle and a two-component cable member 24 extends from the brake actuator 22 towards the standard brake arm 16. The two-component cable member 24 includes a flexible, yet strong, outer sheath portion 26 having distal and proximal ends and an inner flexible, yet strong, cable portion 28 also having distal and proximal ends, the inner cable portion being slidingly received within the outer sheath portion and extending beyond the ends of the outer sheath portion at each end thereof. In the description of the invention as provided herein the distal ends of the cable member portions 26, 28 are the ends to be located in the passenger compartment of the vehicle while the proximal ends of the cable member portions 26, 28 are the ends to be located in the operator's compartment of the vehicle. Two-component cable members are commercially available and are known in the art as "Bowden" cables. Such cables use a twisted steel wire inner cable and a spirally wound steel outer sheath. Both portions of such cables are extremely strong in both compression and tension, yet are sufficiently flexible that the cable can follow a sinuous path from one end to the other without kinking, thereby always allowing relative movement between the inner and outer portions along their co-axial direction.

Figure 2:
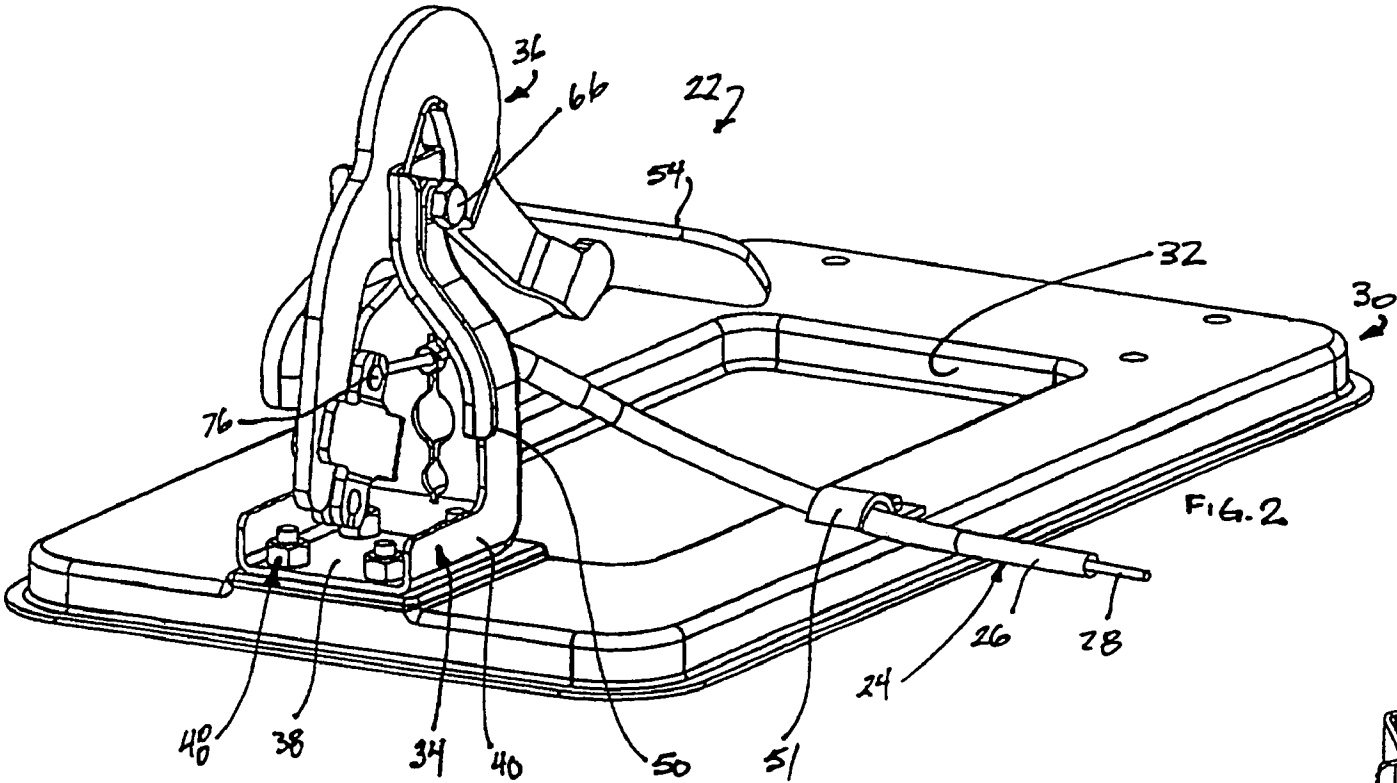
FIG. 2 is a perspective view of the auxiliary brake actuator that is positioned in the passenger compartment of the vehicle.

FIG. 2 shows a rear perspective view of the auxiliary brake actuator 22 that will be located in the passenger compartment. The actuator 22 includes a base member 30 that is adapted to rest on the floor of the passenger compartment, without necessity of being secured to such floor. Thus the base member 30 is free to be positioned anywhere within the passenger compartment that will provide ready access thereto whenever the instructor feels the necessity of applying the brakes of the vehicle via the auxiliary brake control system.

Figure 3:
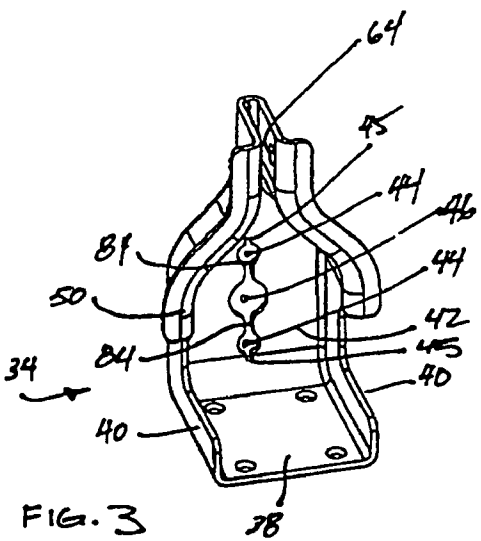
FIG. 3 is perspective view of the support structure that is attached to the base of the base member.

The base member 30 includes a generally rectangular base 32 and an upright support structure 34 that is bolted or otherwise secured to the base 32 at one end thereof. The support structure 34 will, at the top thereof, pivotally support an auxiliary brake pedal 36, which includes an auxiliary pedal pad 54 at the end thereof which will face the instructor in use. Details of the support structure 34 are found in FIG. 3, from which it is seen that the structure includes a bottom wall 38, a pair of upstanding side walls 40 which are necked in towards each other at the upper ends thereof, and a front or forwardly facing wall 42. The front wall 42 includes upper and lower apertures 44 of a first diameter and a central aperture 46 of a second, larger, diameter positioned between the apertures 44. Each aperture 44 includes a slot 45 extending upwardly for the top one or downwardly for the bottom one from the aperture as the case might be, the purpose of which will become apparent hereinafter. The bottom wall 38 is provided with suitable apertures therethrough for the reception of bolts or machine screws 48 which secure the support structure 34 to the base 32. The edges of the upstanding walls 40 can be flanged as at 50 to impart strength to the support member. A clamp 51 attached to the upper surface of the base 32, as by a machine screw, serves to retain the cable member 24 to keep it from unwanted movement in the passenger compartment.

Figures 4, 5, 6, 7, 8:
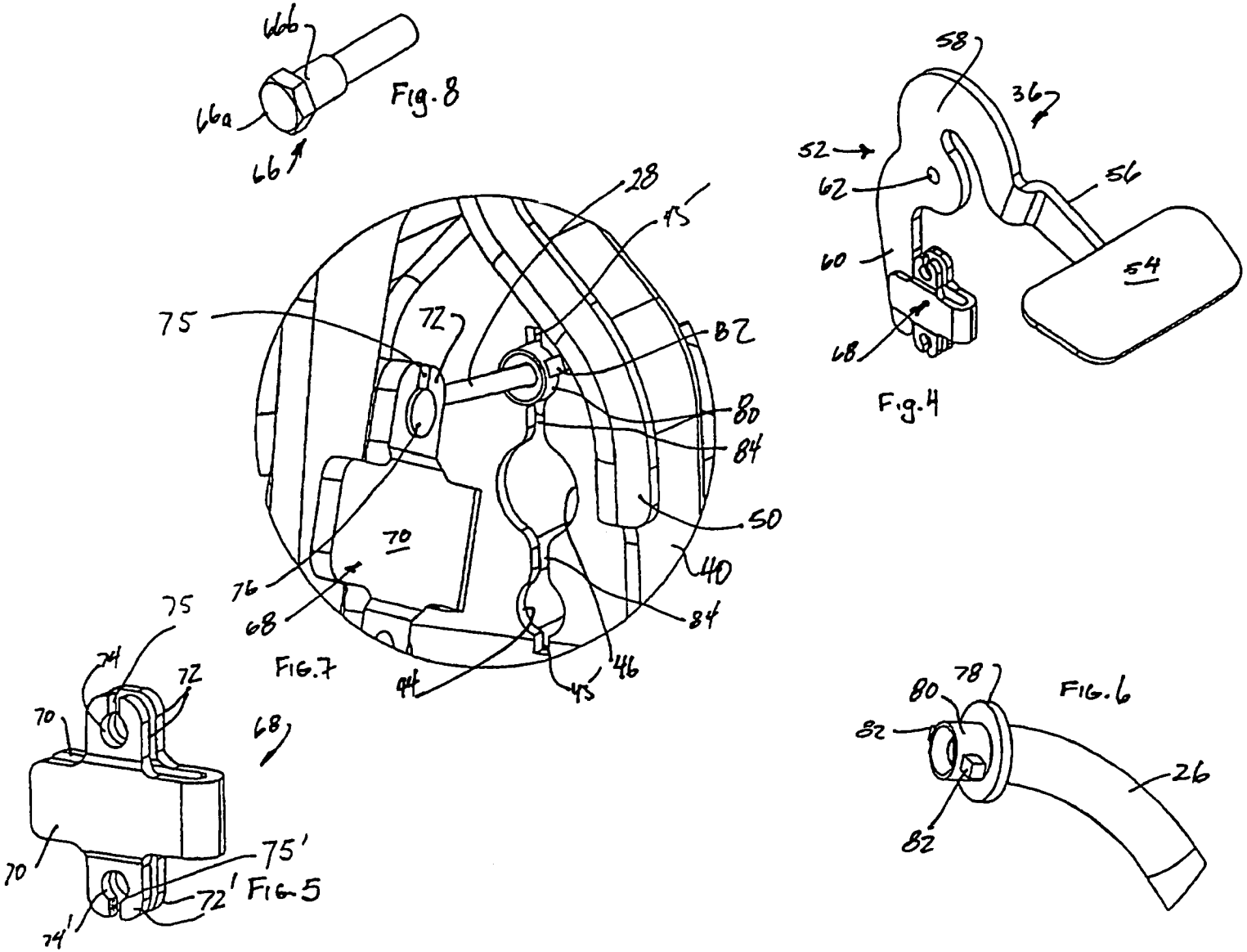
FIG. 4 is a perspective view of the auxiliary brake pedal used with this invention.
FIG. 5 is an enlarged perspective view of the inner cable portion connector that is attached to one end of the auxiliary brake pedal.
FIG. 6 is an enlarged view of one end of the outer sheath portion showing how it can be attached to the support structure.
FIG. 7 is an enlarged perspective view showing the attachment of the outer sheath portion to the support structure.
FIG. 8 is a perspective view of the pin used to attach the auxiliary brake pedal arm to the support structure.

The auxiliary brake pedal 36 is shown in some detail in FIG. 4. There it is seen that the pedal 36 includes a pedal arm 52 with the pedal pad 54 at the free end thereof, generally facing the instructor. The pedal arm 52 includes an upper section 56, a generally C-shaped intermediate section 58 and a lower section 60. A transverse hole 62 at the intermediate section serves to aid in pivotally attaching the pedal arm 52 to the support structure 34 by way of aligned holes 64 in the upper ends of the side walls 40 and a pivot pin 66 which passes through the holes 62, 64. The pin can be secured in place by a cotter pin or other suitable means, such as a nut on a threaded end thereof, so as to prevent inadvertent disengagement of the pin 66 from the holes 62, 64. The pin 66 is shown in greater detail in FIG. 8, wherein it is seen to include a hexagonal head 66*a* and an enlarged diameter shank portion 66*b* below the head. The diameter of the shank portion is greater than the diameter of the holes 64 so that the shank portion will always be located adjacent and outside the side wall 40.

As seen in FIG. 4, the lower end of the lower arm section 60 is provided with a connector member 68, shown in greater detail in FIG. 5. The connector member 68 has side walls 70 which are secured to the lower section 60 in any suitable fashion, as by welding. The side walls 70 have upstanding and depending lugs 72, 72' provided with transverse openings 74, 74' therethrough. Each opening 74, 74' is sized for reception of an enlarged cylindrical connecting pin 76 which is secured transversely to the distal end of the inner cable portion 28. By way of the pin 76 and the mating aperture 74, 74' the exposed end portion of inner cable portion 28 can be securely connected to the lower end of the pedal arm 52 of the auxiliary brake pedal 36. Both depending lugs 72, 72' on one side, either left or right, have slots 75, 75' extending from the aperture 74 to the free end thereof. The slot 75, 75' allows the pin 76 to slide into the aperture 74, 74' with the exposed end portion of the inner cable portion 28 moving through the slot until the exposed end is positioned between the side walls 70. Then the inner cable portion 28 can be rotated relative to the side walls to the position shown in FIG. 7, thereby securely connecting the distal end of the inner cable portion 28 to the connector member. The distal end of the inner cable portion 28 can be connected to the upstanding lugs 72 or to the depending lugs 72' depending on the particular requirements for the particular vehicle in which the present invention is to be located and how much movement between inner cable portion 28 and outer sheath portion 26 is required for operating the brake arm 16. If connected to the depending lugs 72' the inner cable will exhibit greater movement than if it is connected to the upstanding lugs 72.

The distal end of the outer sheath portion 26 includes an enlarged flange portion 78 as best seen in FIG. 6. That flange portion will abut the front wall 42 of the support structure 34 when the cylindrical portion 80 of the outer sheath portion 26 passes through one of the apertures 44 in the front wall 42. The cylindrical portion 80 extending from the flange portion 78 has a pair of radially outwardly extending lugs 82, spaced from the flange by a distance just slightly greater than the thickness of the front wall 42 of the support structure 34. After the portion 80 is pushed through one of the apertures 44, with one of the lugs 82 passing through the appropriate slot 45 and another one of lugs 82 passing through a slot 84 provided between the large aperture 46 and the selected smaller aperture 44, the cylindrical portion 80 is rotated to bring the lugs 82 to a position at 30 degrees to 150 degrees relative to the slot 45 against the rear surface of the front wall 42 (FIG. 7). This mechanism is used to secure the distal end of the outer sheath portion 26 to the support structure 34 and thus to the base member 30.

When assembling the cable member 24 to the base member 30 one would normally pass the cylindrical pin 76 through the selected aperture 44 and then connect it to the appropriate lug 72 via the corresponding aperture 74. If difficulties are encountered in attempting to pass the pin 76 through a aperture 44 then the pin could be passed through the larger aperture 46, with the inner cable portion 28 sliding along the slot 84 provided between the larger aperture 46 and the selected smaller aperture 44, after which the distal ends of the outer sheath portion 26 and the inner cable portion 28 can be connected to and secured with auxiliary brake actuator 22 as desired. FIG. 7 illustrates the distal ends of the outer sheath portion 26 and the inner cable portion 28 in an assembled condition at the support structure 34.

Figure 9:
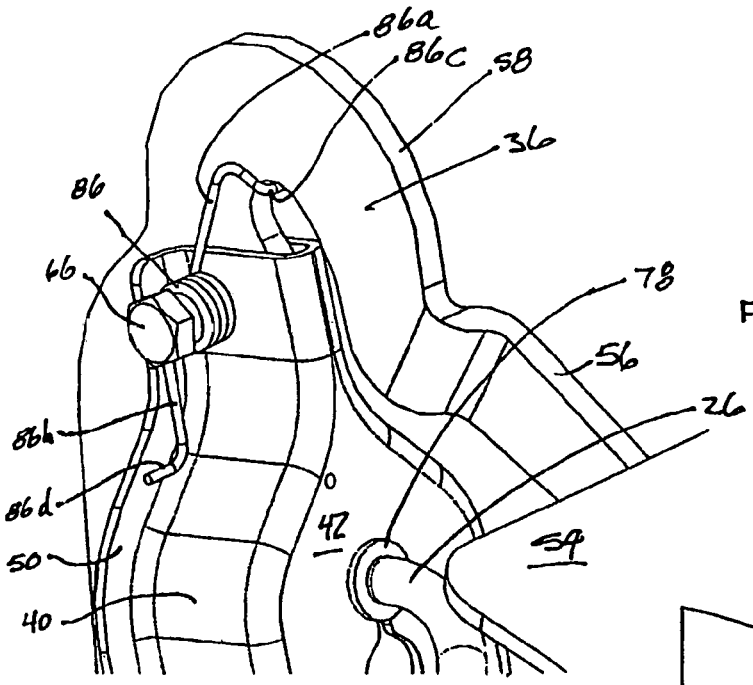
FIG. 9 is an enlarged perspective view showing the attachment of the auxiliary brake pedal arm to the support structure.

FIG. 9 shows in perspective a tension spring 86 which is received on the shank portion of the pin 66. The tension spring 86 has a pair of spring arms 86*a* and 86*b* which extend from the ends of the wound helical center section of the spring. The arm 86*a* extends upwardly towards the C-shaped intermediate section 58 of the pedal 36 and it has a bent portion 86*c* which extends into the arcuate slot area of arm section 56. The other arm 86*b* extends downwardly and in front of the flange 50 and has a bent portion 86*d* which bears against the surface of the flange 50. It is clear that when the auxiliary brake pedal 36 is depressed, so as to rotate clockwise in FIG. 9, the tension in the spring 86 will be increased so that when the auxiliary brake pedal 36 is released the increased tension in the spring 86 will help to restore the auxiliary brake pedal 36 to its original position, ready to be operated again.

Figure 10:
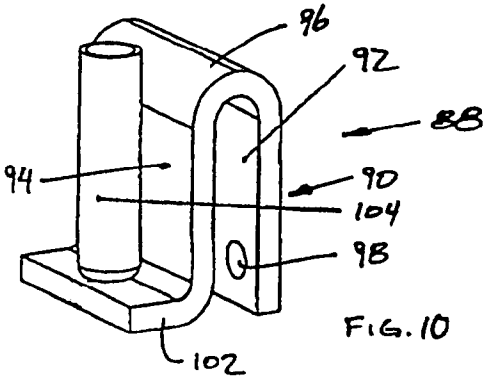
FIG. 10 is a perspective view of the bracket which is connectable to the standard brake arm.
Figure 11:
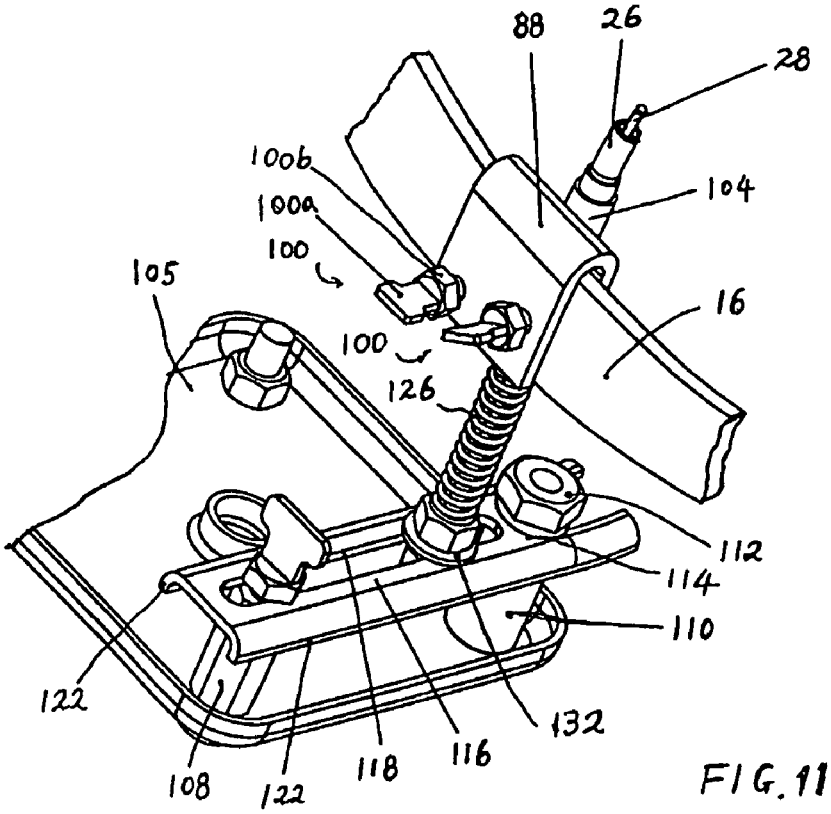
FIG. 11 is a perspective view showing the connections of the cable members, including inner cable portion and outer sheath portion, with standard brake arm and floor section within the operator's compartment of the vehicle.

FIG. 10 shows a perspective view of a mounting bracket 88 that is used to connect the proximal end of the outer sheath portion 26 to the brake arm 16. The bracket 88 includes a generally inverted U-shaped section 90 having side walls 92, 94 and a rounded bight portion 96. Threaded holes 98 in the side wall 92 are adapted to receive threaded thumbscrews 100 for releasably connecting the bracket to the brake arm. As seen in FIG. 11 the thumbscrew 100 preferably has a flattened outer section 100*a* for manual rotation of the thumbscrew and a hexagonal intermediate section 100*b* for the application of a wrench for additional tightening. The side wall 94 has a laterally extending flange portion 102 with an upstanding hollow cylinder 104 welded thereto for sliding reception therein of the proximal end of the outer sheath portion 26. Although not visible in FIG. 10 the flange portion 102 is provided with a hole through which the proximal end of the inner cable portion can pass but through which the cylindrical portion of the proximal end of the outer sheath portion 26 cannot pass. It should be noted that the proximal end of the inner cable portion 28 is not provided with a laterally located cylindrical pin 76 as is found at the distal end, and hence there is no problem in the proximal end of the inner cable portion 28 passing through the hole in the flange portion 102.

Figure 13:
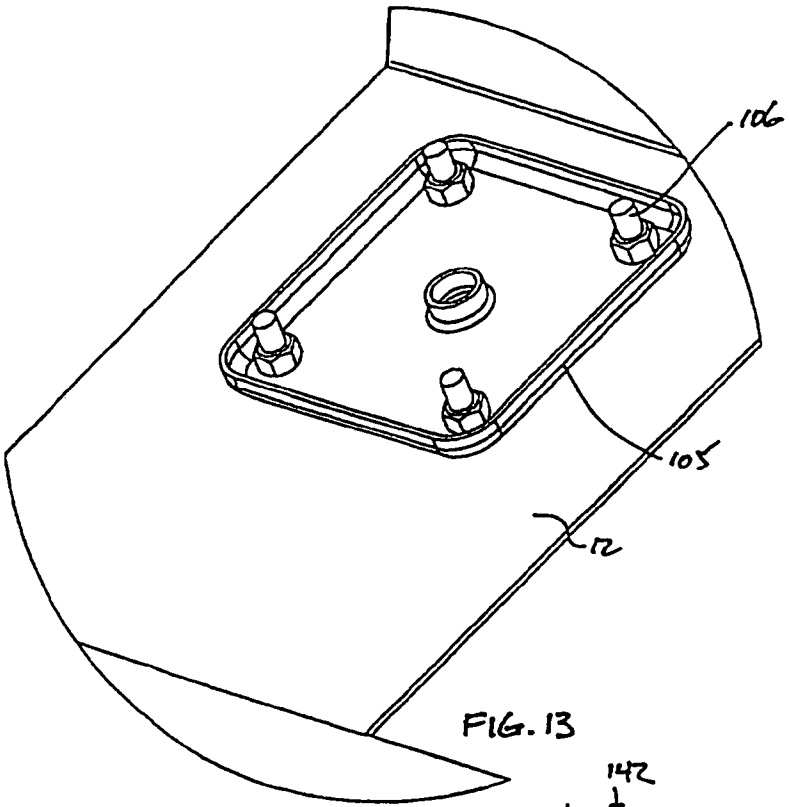
FIG. 13 is perspective view of a bracket which should be part of the vehicle, for mounting the brake master cylinder and which will be used with the present invention.

Generally directly below the brake arm 16 the vehicle should have a bracket 105 already provided for mounting the brake master cylinder (not shown). Typically, such a bracket will have holes therethrough, through which threaded studs 106, welded to the vehicle floor, are received (see FIG. 13). Nuts are threaded onto the studs and tightened to hold the bracket tight to the vehicle floor. In order to connect the proximal end of the inner cable portion 28 to the vehicle floor below the brake arm 16 the nuts normally attached to two of the threaded studs 106, which are close to the vehicle operator, are removed and elongated internally threaded posts 108, 110 are threadedly attached to the studs 106 (see FIG. 11 and FIG. 14). The post 108 preferably has a hexagonal shape over its length and it is provided with a threaded bore (not shown) extending therethrough from its top surface. The post 110 may be mostly cylindrical as shown and it has a hexagonal head 112 at the top thereof, with a circumferential groove 114 formed in the cylindrical body of the post, below the head 112. When the posts 108 and 110 are both fully secured to the studs 106 the top surface of the post 108 and the bottom edge of the groove 114 will be coplanar and have same heights from floor section 12.

Figure 14:
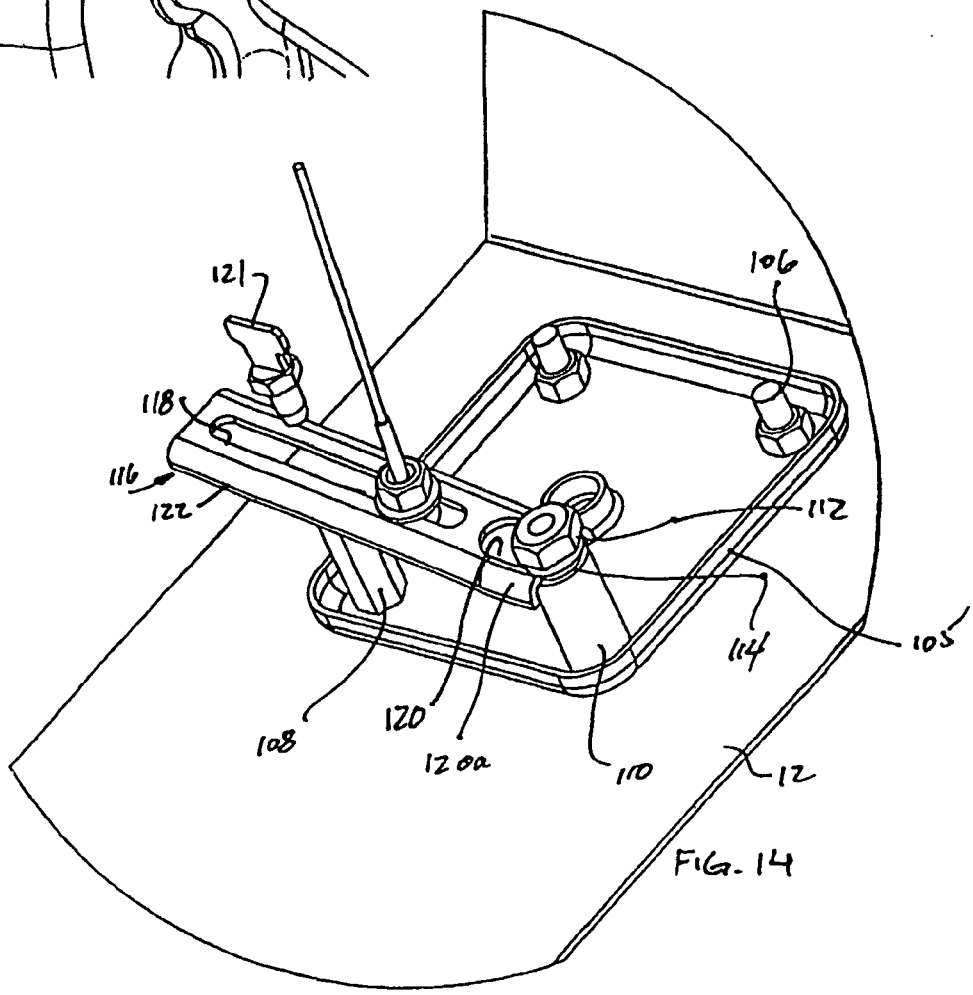
FIG. 14 is a perspective view of the bracket system for connecting the proximal end of the inner cable portion to the floor section of the vehicle.
Figure 12:
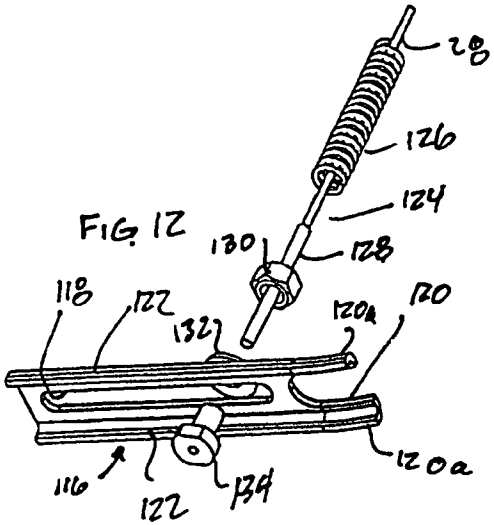
FIG. 12 is an exploded view showing the connection of the proximal end of the inner cable portion to its mounting bar.

With reference to FIGS. 11, 12 and 14 it is seen that an elongated, generally rectangular bar 116 has an elongated slot 118 therein and an open U-shaped slot 120 at one end. The slot 120 has a width less that the diameter of post 110 but it can be accepted within the groove 114. The slot 118 is adapted to receive a threaded thumbscrew 121 which is receivable in the threaded bore in the post 108. Thumbscrew 121 is similar in shape to thumbscrew 100. Preferably the bar 116 is of an inverted U-shape having side flanges 122 along the length thereof, such that the central section of the bar, between the flanges 122, is just slightly wider than the width or diameter of the posts 108, 110. The two end arms 120*a* which define the slot 120 are deflected slightly upwardly relative to the rest of the bar. During assembly the arms 120*a* are slid into the groove 114 which causes the rest of the bar 116 to be angled upwardly away from post 108. When thumbscrew 121 is threaded into the post 108 and tightened a biasing force will be applied against the thumbscrew 121 by the bar 116. Should the thumbscrew loosen at all, perhaps due to vibration, it is less likely to become disengaged from the post, due to such biasing force, than if the arms 120*a* were not deflected relative to the rest of the bar. The biasing force places the thumbscrew 121 in tension at all times.

With reference to FIGS. 11 and 12 the manner in which the proximal end of the inner cable portion 28 is connected to the bar 116 is illustrated. There it is seen that the proximal end 124 of the inner cable portion 28 is crimped or welded to a externally threaded tube 128 over which a compression spring 126 is slid, the tube 128 being provided with a nut 130 loosely positioned thereabout. The free end of the tube 128 receives a washer 132 and is passed through the slot 118 in the bar 116. A threaded stud 134 having a threaded bore therethrough for reception of tube 128 and a flatted head extends through the slot 118 and the washer 132 for threaded reception in the nut 130.

Before installing the compression spring 126 on the inner cable portion 28, one should assemble the mounting bracket 88 to the proximal end of outer sheath portion 26 and inner cable portion 28 first by passing the tube 128 through the hollow cylinder 104 and the hole on flange portion of the bracket 88, and then engaging the proximal end of outer sheath portion 26 with the bracket 88 entirely.

The assembly of the proximal end 124 of inner cable portion 28 to the bar 116 is to be accomplished with engagement between stud 134 and nut 130 and engagement between tube 128 and stud 134 prior to the bar 116 being attached to the posts 108, 110. Thereafter, the bar is positioned above the post 108 and it is slid towards the post 110 so that arms 120*a* defining the open slot 120 will be received within the groove 114 of the post 110. The thumbscrew 121 will be passed through the slot 118 for threaded reception in the threaded bore in the top section of the post 108 and tightened to force the bar downwardly and to secure it in place. If the proximal end 124 of the inner cable portion 28 is not properly located relative to the brake arm 16 in the cross-car direction, the nut 130 can be loosened and the proximal end 124 in conjunction with tube 128, nut 130, washer 132 and stud 134 can be moved together laterally along the slot 118 until a proper location has been established, following which the nut 130 is retightened.

Figure 15:
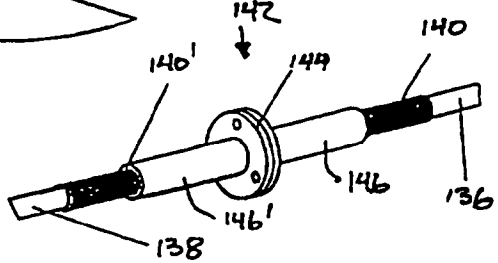
FIG. 15 is a partial perspective view showing a means for adjusting the total length of the outer sheath portion of the cable assembly.

FIG. 15 shows a mechanism by which the length of the outer sheath portion 26 can be adjusted for application of the present invention to different vehicles, or more specifically, to vehicles having different distances between upper edges of arm 16 and floor section 12, to achieve adequate installation of inner cable portion 28 with bar 116 and installation of bracket 88 with brake arm 16. For this adjustment mechanism to work, the outer sheath portion is provided in two sections 136, 138. The first section 136 includes the connections at the distal end of the outer sheath portion for connecting the outer sheath portion to the auxiliary brake actuator 22 in the passenger compartment while the second section 138 includes the connections at the proximal end of the outer sheath portion for connecting the outer sheath portion to the brake arm 16. At the facing ends of the first and second sections each is provided with a threaded end 140, 140', one end having a right-hand thread and the other having a left-hand thread. An adjustment member 142 having a central flange 144 and outwardly projecting threaded tubes 146, 146' connects the threaded ends 140, 140'. The tubes 146, 146' are threaded internally for mating reception of the threaded ends 140, 140'. If the adjustment member 142 is rotated in one direction it will draw the threaded ends 140, 140' closer together, effectively shortening the total length of the outer sheath portion 26. If the adjustment member 142 is rotated in the opposite direction it will push the threaded ends 140, 140' farther apart, effectively increasing the total length of the outer sheath portion 26.

For installation of the bracket 88 to the brake arm 16, the outer sheath portion 26 may be shortened first as by using the adjustment member 142 that the inverted U-shaped section 90 can move high enough and cover the upper edge of brake arm 16. Secondly an optimal position for arranging the proximal end of outer sheath portion 26 is found through adjusting the bracket 88 along the upper edge of the brake arm 16. Thirdly the adjustment member 142 is rotated in opposite direction to increase the total length of the outer sheath portion 26 enough so that the internal face of the bight portion 96 of the bracket 88 touches the upper edge of the brake arm 16. Fourthly the thumbscrews 100 are engaged with threaded holes 98 until the bottom of thumbscrews 100 engage brake arm 16 tightly. With the bracket 88 optimally positioned on the brake arm there should be no binding of the inner cable portion relative to the outer sheath portion or the bracket 88 and there should be smooth routing of the cable member to the passenger compartment of the vehicle.

Figure 16:
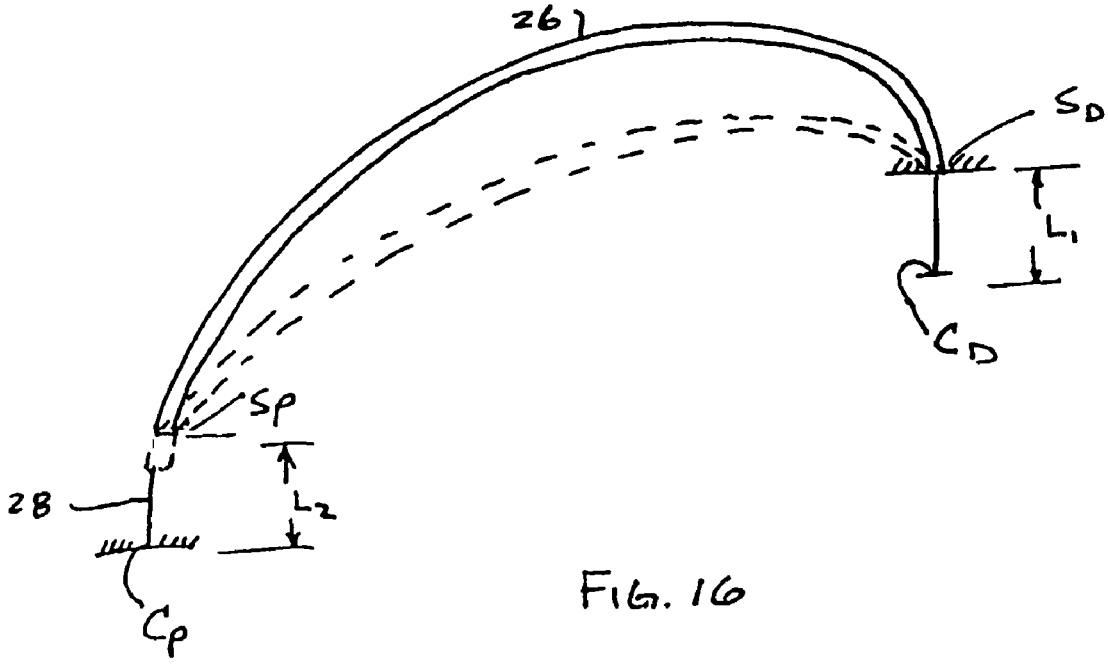
FIG. 16 is a schematic view showing the principle of operation of the present invention.

Principles and Operation—FIG. 16

FIG. 16 shows the principle of operation of the present invention. It should be understood that with the components in position within a vehicle the cable member 24 is unconstrained between the brake arm 16 and the brake actuator 22 in this preferred embodiment. Thus the cable member 24 will rest on the vehicle floor and/or a console as it extends from the actuator 22 to the brake arm 16. As seen in FIG. 16 the distal end $S_D$ of the outer sheath portion 26 is secured to the base member 30 of auxiliary brake actuator 22 and the distal end $C_D$ of the inner cable portion 28 is attached to the lower end of the pedal 36. The length of inner cable projecting from the end of the outer sheath is shown as $L_1$. At the opposite end the proximal end $S_P$ of the outer sheath portion is located at the brake arm 16 via the bracket 88 and the proximal end $C_P$ of the inner cable portion is connected to the vehicle floor. The length of the inner cable projecting from the end of the outer sheath at the proximal end is shown as $L_2$. When the auxiliary pedal is operated the effect is to try to increase the length $L_1$ since the distal end $S_D$ of the outer sheath portion is fixed. However, the proximal end $C_P$ of the inner cable portion is also fixed, and consequently it is impossible for the inner cable to stretch or to lengthen relative to the outer sheath portion 26. In other words, $L_1+L_2$ is constant. If the distance $L_1$ is increased due to the operation of the auxiliary pedal then the distance $L_2$ must decrease. Since the distance $L_2$ is the length of the proximal end $C_P$ of the inner cable portion that projects beyond the proximal end $S_P$ of the outer sheath portion and since the proximal end $C_P$ of the inner cable portion is fixed, the result is that the proximal end $S_P$ of the outer sheath portion must approach the floor of the vehicle. This means that the brake arm 16 moves towards the floor, the end result being that the vehicle brakes are applied via the brake arm 16.

When the brake arm 16 is depressed, whether by the auxiliary brake control system of the present invention, and/or by normal braking as initiated by the vehicle operator, the compression spring 126 located between the mounting bracket 88 and the nut 130 will be compressed somewhat. When the braking action is terminated, either by the operator removing his foot from the brake pedal 18 and/or the instructor removing his foot from the auxiliary brake pedal 36, the spring 126 will aid in returning the brake arm 16 to its normal rest position, ready for another brake application. As mentioned earlier, the tension spring 86 will help to return the auxiliary brake pedal to its normal position following operation thereof. Thus when both the auxiliary brake pedal 36 and the normal brake arm 16 are operated together both springs 86 and 126 will help to return the respective pedals to the normal rest position thereof following release thereof and they will also work together if only the auxiliary brake pedal is operated.

Since the proximal end $S_P$ of the outer sheath portion is not fixed to the bracket 88, but only has a sliding fit within the cylindrical tube 104, the outer sheath portion will not interfere with normal operation of the brake pedal 16 and the vehicle's braking system (without operation of the auxiliary brake actuator 22), and since the tension spring 86 retains the auxiliary brake pedal 36 in its rest position, no relative movement between the outer sheath portion 26 and the inner cable portion 28 is rendered.

DESCRIPTION—ALTERNATIVE EMBODIMENTS

With the preferred embodiment of present invention, the distal end of outer sheath portion 26 is connected with base member 30, and the distal end of inner cable portion 28 is connected with auxiliary brake pedal 36.

For an alternative application, above connection relationship can be reversed as that the distal end of outer sheath portion 26 is connected with auxiliary brake pedal 36, and the distal end of inner cable portion 28 is connected with base member 30.

With the preferred embodiment of present invention, the proximal end of outer sheath portion 26 is connected with brake arm 16, and the proximal end of inner cable portion 28 is connected to floor section 12.

For an alternative application, above connection relationship can be reversed as that the proximal end of outer sheath portion 26 is connected with floor section 12, and the proximal end of inner cable portion 28 is connected with brake arm 16.

RAMIFICATION, SCOPE, AND CONCLUSION

The present invention can be applied with any kind of vehicle, including a vehicle with a motor, an electrical vehicle, and a hybrid etc.

With the same principle, the present invention can also be applied to a clutch or an accelerator of a vehicle, or the like.

With above descriptions and drawings, we can conclude that the auxiliary brake control system provides a dual brake apparatus for driving practice. Compared with prior arts, this apparatus has much less parts, is easy-installed, and therefore, significantly cheaper, and works with higher efficiency, and safer. It is also equivalently easy to be removed with minimized harm to the vehicle with which the apparatus is installed.

It is anticipated that a skilled person would be able to modify various aspects of the present invention without departing from the spirit thereof and thus the protection to be afforded this invention is to be determined from the scope of the claims and equivalents appended.

The invention claimed is:

1. An auxiliary brake control system for a vehicle having wheel brakes, and a brake pedal in an operator's compartment of said vehicle, controllable by a vehicle operator, said brake pedal being secured to a brake arm pivotally attached to a frame member in the operator's compartment and being positioned above a floor section of such vehicle, said auxiliary brake control system comprising: an auxiliary brake actuator positionable in a passenger compartment of such vehicle, said auxiliary brake actuator including a base member and an auxiliary pedal member pivotally attached to said base member; a cable member including an outer sheath portion and an inner cable portion within said outer sheath portion; first means connecting a distal end of said outer sheath portion to said base member: second means locating the opposite, proximal, end of said outer sheath portion at said brake arm; third means connecting a distal end of said inner cable portion to said auxiliary pedal member; and fourth means connecting the opposite, proximal, end of said inner cable portion to said floor section of said vehicle; at least a section of said cable member being unconstrained between said first and second means; whereby when a passenger applies force on said auxiliary pedal member said outer sheath portion of said cable member will move relative to said inner cable portion such that said second means will act on said brake arm to apply said vehicle wheel brakes.

2. The auxiliary brake control system according to claim 1 wherein said cable member is a Bowden cable with said inner cable portion being a flexible metallic cable and said outer sheath portion being a braided flexible metallic sheath, said inner cable portion extending beyond said outer sheath portion at each end thereof.

3. The auxiliary brake control system according to claim 2 wherein: said base member is adapted to sit on a floor section of said passenger compartment; a support section extends upwardly from said base member adjacent one end thereof; and a pivot means connects said auxiliary pedal member intermediate first and second ends thereof to said support section above said base member.

4. The auxiliary brake control system according to claim 3 wherein: said first end of said auxiliary pedal member includes a pad on which the passenger can apply force to operate said auxiliary brake control system; and said third means is adapted to connect said distal end of said inner cable portion to said second end of said auxiliary pedal member.

5. The auxiliary brake control system according to claim 4 wherein: said first means is adapted to connect said distal end of said outer sheath portion to said support section below said pivot means such that said inner cable portion can extend through said support section for connection to said second end of said auxiliary pedal member.

6. The auxiliary brake control system of claim 5 wherein said support section includes upstanding side and front walls, and said first means comprises: at least one aperture extending through said front wall, sized to pass said distal end of said inner cable portion therethrough; a circumferential flange adjacent said distal end of said outer sheath portion for abutment against a front surface of said front wall at said aperture, a cylindrical portion of said outer sheath portion passing through said aperture; and a pair of lugs extending radially from said cylindrical portion, engagable with a rear surface of said front wall for securing said distal end of said outer sheath portion to said front wall.

7. The auxiliary brake control system of claim 6 wherein said third means comprises: a connector secured to the second end of said auxiliary pedal member, said connector having at least one pair of lugs having a transverse aperture therethrough, with a open slot extending from said transverse aperture on at least one of said lugs to the free end thereof; and a connection pin secured transversely to the distal end of said inner cable portion, said pin being receivable in said transverse aperture by passing said distal end of said inner cable portion through said open slot for connecting said distal end of said inner cable portion to said auxiliary pedal member.

8. The auxiliary brake control system of claim 3 including a torsion spring surrounding said pivot means connecting said auxiliary pedal member to said support section, with one end of said torsion spring abutting said auxiliary pedal member and the other end of said torsion spring abutting said support section, said torsion spring serving to aid in returning said auxiliary pedal member to the unactuated state thereof following operation thereof.

9. The auxiliary brake control system according to claim 1 including adjustment means intermediate the ends of said outer sheath portion for adjusting the length of said outer sheath portion and thereby adjusting the initial location of the proximal end of said outer sheath portion with respect to the proximal end of said inner cable portion.

10. The auxiliary brake control system according to claim 9 wherein said outer sheath portion includes first and second sections, said first means being at said distal end of said first section and said second means being at said proximal end of said second section, said adjustment means being threadedly connected to the proximal end of said first section and to the distal end of said second section whereby movement of said adjustment means in one direction will bring said distal end of said first section closer to said proximal end of said second section so as to effectively shorten said outer sheath portion, and movement of said adjustment means in an opposite direction will move said distal end of said first section away from said proximal end of said second section so as to effectively lengthen said outer sheath portion.

11. The auxiliary brake control system according to claim 2 wherein: said second means comprises a mounting bracket securable to said brake arm and connection means adapted to position said proximal end of said outer sheath portion at said mounting bracket.

12. The auxiliary brake control system according to claim 11 wherein: said fourth means comprises a connection member removably securable to said floor section of said operator's compartment below said brake arm; and second connection means adapted to connect said proximal end of said inner cable portion to said connection member.

13. The auxiliary brake control system of claim 12 wherein said second means comprises: a generally flat bar member having a longitudinally extending slot therethrough and also having an open ended slot at one end thereof defined by a pair of spaced apart arm portions; a pair of posts for supporting said bar member above said floor section below said brake arm; a threaded nut on the proximal end of said inner cable portion spaced from the free end thereof; and a threaded stud having a central bore therethrough for threaded reception of said free end, said threaded stud extending through said longitudinally extending slot for threaded engagement with said threaded nut to secure said proximal end of said inner cable portion to said bar member.

14. The auxiliary brake control system of claim 13 wherein one of said posts has a threaded bore extending inwardly from a top surface therethrough and the other of said posts has a circumferential groove in a shank portion thereof, said groove being adapted for sliding reception of said spaced apart arm portions and said threaded bore being adapted for threaded reception of threaded fastening means extending through said longitudinally extending slot.

15. The auxiliary brake control system of claim 14 wherein said arm portions are deflected upwardly relative to the remainder of said bar member.

16. The auxiliary brake control system of claim 15 including a compression spring surrounding the proximal end of said inner cable portion between said bar member and said mounting bracket.

17. The auxiliary brake control system of claim 11 wherein said mounting bracket has a generally inverted U-shape for fitment over said brake arm, one leg of said mounting bracket being adapted to receive at least one threaded thumbscrew for clamping said mounting bracket to said brake arm, the other leg of said mounting bracket including a laterally extending flange having an aperture therethrough and a hollow cylindrical tube member extending upwardly from said flange, said proximal end of said outer sheath portion being receivable within said hollow cylindrical tube member, and said proximal end of said inner cable portion extending though said aperture in said flange.

18. An auxiliary brake control system for a vehicle having wheel brakes, and a brake pedal in an operator's compartment of said vehicle, controllable by a vehicle operator, said brake pedal being secured to a brake arm pivotally attached to a frame member in an operator's compartment of the vehicle and being positioned above a floor section of such vehicle, said auxiliary brake control system comprising: an auxiliary brake actuator positionable in a passenger compartment of such vehicle, said actuator including a base member, a support structure secured to said base member and an auxiliary pedal member pivotally attached intermediate the ends thereof to said support structure above said base member; a cable member including an outer sheath portion and an inner cable portion within said outer sheath portion; first means connecting a distal end of said outer sheath portion to said support structure below said auxiliary pedal member: second means locating the opposite, proximal, end of said outer sheath portion at a mounting member adapted for removable attachment to said brake arm; third means connecting a distal end of said inner cable portion to one end of said auxiliary pedal member; and fourth means connecting the opposite, proximal, end of said inner cable portion to a connection member adapted for removable attachment to said floor section of said vehicle below said mounting bracket; at least a section of said cable member being unconstrained between said first and second connecting means; whereby when a driving instructor applies force on the other end of said auxiliary pedal member said outer sheath portion of said cable member will move relative to said inner cable portion such that said second means will act on said mounting member and thus on said brake arm to depress said brake pedal sufficiently to apply said vehicle wheel brakes.

19. The auxiliary brake control system according to claim 18 wherein said outer sheath portion includes first and second sections, said first means being at said distal end of said first section and said second means being at said proximal end of said second section, and including an adjustment member being threadedly connected to the proximal end of said first section and to the distal end of said second section whereby rotational movement of said adjustment means in one direction will bring said distal end of said first section closer to said proximal end of said second section so as to effectively shorten said outer sheath portion, and rotational movement of said adjustment member in the opposite direction will move said distal end of said first section away from said proximal end of said second section so as to effectively lengthen said outer sheath portion.

20. The auxiliary brake control system according to claim 19 wherein each of said distal and proximal ends of said first and second sections is provided with a threaded extension, one of said threaded extensions having a right-hand thread and the other of said extensions having a left-hand thread, said adjustment member having threaded sections for threaded engagement with said threaded extensions.

21. An auxiliary brake control system for a vehicle having wheel brakes, and a brake pedal in an operator's compartment of said vehicle, controllable by a vehicle operator, said brake pedal being secured to a brake arm pivotally attached to a frame member in an operator's compartment of the vehicle and being positioned above a floor section of such vehicle, said auxiliary brake control system comprising:

an auxiliary brake actuator arbitrarily positionable in a passenger compartment of such vehicle, said actuator including a base member and an auxiliary pedal member pivotally attached to said base member;

an elongated flexible cable member including an outer sheath portion and an inner cable portion within said sheath portion;

first means connecting a distal end of said outer sheath portion to one of said base member and said auxiliary pedal member:

second means connecting the opposite, proximal, end of said outer sheath portion to one of said brake arm and said floor section of said vehicle;

third means connecting a distal end of said inner cable portion, extending beyond said distal end of said outer sheath portion, to the other of said base member and said auxiliary pedal member; and fourth means connecting the opposite, proximal, end of said inner cable portion, extending beyond said proximal end of said outer sheath portion, to the other of said brake arm and said floor section of said vehicle;

at least a section of said cable member being unconstrained between said distal and proximal ends of said outer sheath portion;

whereby when a passenger applies force on said auxiliary pedal member said outer sheath portion of said cable member will move relative to said inner cable portion to effectively reduce the distance that said proximal end of said inner cable portion extends beyond said proximal end of said outer sheath portion, thereby causing said brake arm to move sufficiently to cause said servo system to apply said vehicle wheel brake.

* * * * *